United States Patent [19]

Dresel

[11] Patent Number: 4,565,375

[45] Date of Patent: Jan. 21, 1986

[54] GAME APPARATUS

[76] Inventor: Donald W. Dresel, 10213 Overhill Dr., Santa Ana, Calif. 92705

[21] Appl. No.: 703,610

[22] Filed: Feb. 21, 1985

[51] Int. Cl.[4] ..... A63B 67/06

[52] U.S. Cl. ..... 273/401

[58] Field of Search ..... 273/398–402

[56] References Cited

U.S. PATENT DOCUMENTS 2,050,914 8/1936 Anderson ..... 273/401

3,628,793 12/1971 Mudloff ..... 273/402

4,243,229 1/1981 Huser et al. ..... 273/402

FOREIGN PATENT DOCUMENTS 23051 of 1899 United Kingdom ..... 273/398

*Primary Examiner*—Paul E. Shapiro

*Attorney, Agent, or Firm*—G. Donald Weber, Jr.

[57] ABSTRACT

A unique game apparatus which can be used indoors or outdoors as a means for recreation and skill. The game apparatus includes one or more receiving or target means and one or more objects which can be thrown or projected towards the target area.

15 Claims, 4 Drawing Figures

GAME APPARATUS

BACKGROUND

1. Field of the Invention

This invention is directed to a game apparatus, in general, and to such an apparatus which requires dexterity and skill in order to achieve a satisfactory score, in particular. Even more particularly, the apparatus includes a target area and objects which can be thrown or projected at the target area.

2. Prior Art

There are many types of games or toys which are known in the art which are used to develop hand-to-eye coordination. Many of these games are used to healthy competition in terms of relaxation and/or recreation. Some games have developed to a competitive level wherein competition is held to determine rankings or championships relative to the sport associated with the game and its associated apparatus. Some of these types of games include darts, quoits, horseshoes or the like. Each of the named sports has a specific requirement for the participants. For example, in the game of darts, a pointed projectile and a target board are utilized. In the game of quoits, ring-shaped devices, particularly of a braided cord or the like, are tossed at, and hopefully, on a peg which may be driven into the ground or affixed to a support base for indoor usage. In the case of horseshoes, horseshoe shaped elements of rubber, steel or the like are tossed at and, hopefully, on a peg which is driven into the ground. In the case of horseshoes, a pit of sand or soft earth is usually provided around the peg.

It is well known that each of these sports or games can be conducted indoors or outdoors. It is also well known that various kinds of competitions can be engaged in relative to these games. The competition can, often, become quite keen and may include prizes, wagers or the like.

There are many other kinds of games which are known in the art and which require a similar kind of dexterity. However, for purposes of this discussion, most of these types of games are not considered pertinent or necessary to describe in this discussion. Suffice it to say that numerous type of games or apparatus are in use and are, from time to time, developed. The game apparatus of this application is one of the more recent innovations in this area.

SUMMARY OF THE INSTANT INVENTION

This invention is directed to a game apparatus of the target/toss type. In general, the target area includes a receptacle having three dimensions. The three dimensions are typically, but not limited to, definitive of a rectilinear device. In the upper surface of the receptacle there is provided an opening which passes through the upper surface to the interior of the receptacle. At one side of the receptacle is placed an upright barrier or background. The background is used to provide a carom surface for the apparatus.

In one refinement of the invention, appropriate patterns may be defined on the upper surface adjacent the aperture therethrough. Also, the receptacle may have an open bottom or it may include an opening in one side thereof to retrieve any projectiles which fall into the receptacle through the aperture.

The projectiles which are used in this apparatus are generally disk-shaped devices which are slightly smaller in diameter than the aperture in the upper surface of the receptacle. Typically, the disk will have sufficient body so that it can be tossed, with a degree of accuracy, at the receptacle. The object of the apparatus is to toss the disk onto the upper surface of the receptacle and, directly or on a rebound, through the aperture in the upper surface into the interior portion of the receptacle.

DESCRIPTION OF A PREFERRED EMBODIMENT

Figure 1:
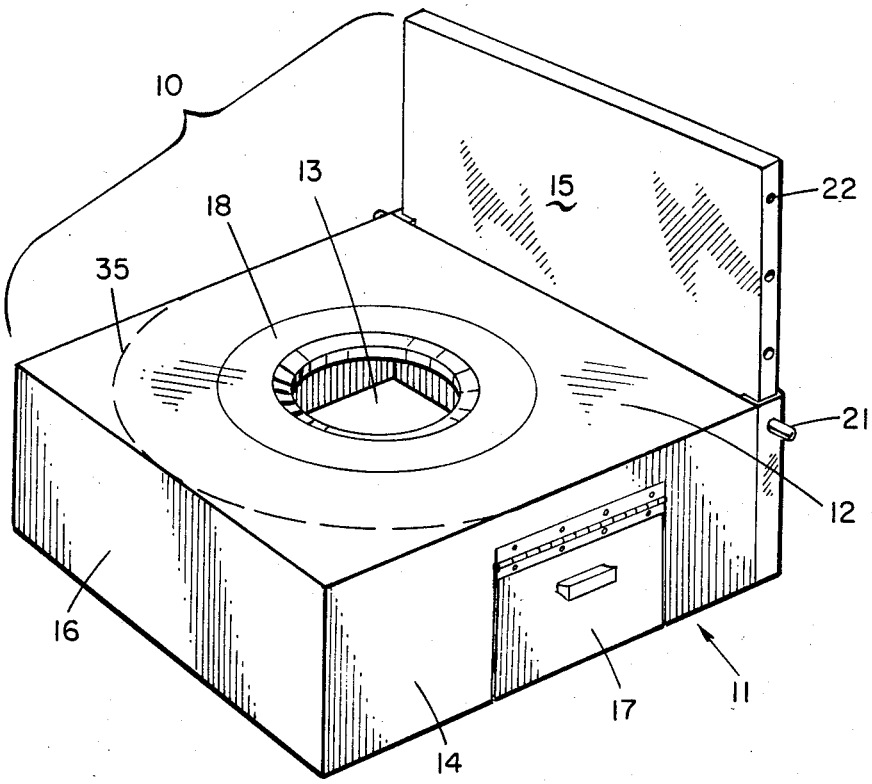
FIG. 1 is a perspective view of the target portion of the apparatus.

Referring now to FIG. 1, there is shown a perspective view of the target or receptacle apparatus 10 of the instant invention. The target apparatus 10 includes, in this embodiment, a receptacle portion in the nature of a rectilinear cubicle 11 and a backboard 15. The receptacle 11 includes an upper surface 12 which has an aperture 13 which passes therethrough. The upper surface 12 is affixed to appropriate side members 11 and 14. Side 19 (not visible in FIG. 1) is opposite to side 14. These sides or uprights provide suitable support for the upper surface 12.

Backboard 15 is disposed adjacent to or forms one side of the box arrangement 11. Backboard 15 is designed to project above the surface of the top member 12. In a preferred embodiment, backboard 15 has a width dimension which is equal to the full width of the box 11. The heighth of backboard 15 above surface 12 of box 11 of the target apparatus 10 is a function of the degree of difficulty which is desired in operating the apparatus or playing the game. For example, if backboard 15 extends a substantial distance above surface 12, a large rebound or backboard area is provided. On the other hand, if backboard 15 extends only a very short distance above the top of surface 12, a very shallow rebound area is provided and greater dexterity is required of the player.

In one embodiment, an access door 17 is provided in one of the side members 14. Door 17 is necessary and/or desirable in those instances when a bottom member (not shown) is fastened to or included in receptacle box 11. In the event that a bottom or floor member is not provided, door 17 need not be provided either. In the event that door 17 is provided, a suitable knob and hinge arrangement are required.

Also, as shown in FIG. 1, suitable patterns such as targets, concentric rings or the like 18 can be painted on the surface of upper layer 12.

Figure 2:
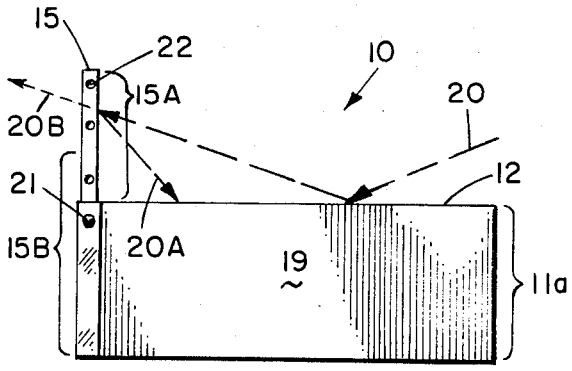
FIG. 2 is a side view of the target portion of the apparatus.

Referring now to FIG. 2, there is shown a side view of the apparatus 10. In this view the side 19 (not visible in FIG. 1) is shown. In addition, the relationship of backboard 15 to the receptacle 11 is also shown. It is further shown that the heighth of the backboard 15 above the receptacle defined by the dimension 15A can vary and alter the game conditions. For example, if the projectile hits the upper surface 12 at the angle indicated by the trajectory line 20, the projectile will rebound from the surface 12. If the backboard 15 has the heighth 15A, the projectile will strike the backboard and rebound onto the surface of the target apparatus as indicated by trajectory 20A. If the backboard 15 is made smaller and terminates at the height 15B, the same projectile with the same trajectory 20 will rebound off the surface 12 of the apparatus and follow the trajectory line 20B (shown dashed) and, thereby, become a non-scoring effort.

In order to control the level of difficulty in playing the game, backboard 15 may be adjustable. In this case, backboard 15 may be adjustable in grooves or other support apparatus affixed to the rear of the receptacle 11. The edges of backboard 15 may include a plurality of holes 22 or the like into which a peg 21 may be selectively positioned. By appropriately positioning peg 21 in one of the holes 22, the heighth of backboard 15 can be adjusted.

Figure 3:
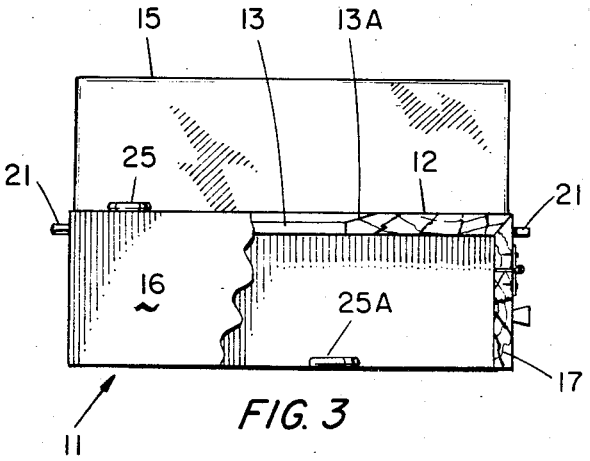
FIG. 3 is a partially broken away front view of the apparatus showing the disks which are utilized therewith.

Referring now to FIG. 3, there is shown a partially broken away view of the apparatus. In this case, the receptacle 11 is shown as being substantially hollow with no floor or bottom surface therein. In this case, the apparatus rests on the surface of the location wherein the game is played. In this Figure, door 17 is shown although it is not essential with the particular apparatus involved, i.e. without a floor member. The positions of pegs 21 relative to backboard 15 are also shown.

In this instance, aperture 13 is shown to have a beveled surface 13A which can be used in some embodiments of the invention to provide a type of guide for the projectiles 25 which are shown in the Figure. In particular, one of the projectiles 25 is shown resting on the surface 12 while another of the projectiles 25 is shown resting within the receptacle 11. The projectile 25 resting on the surface would, in the ordinary course of the game, score points in accordance with its position which is a function of the pattern defined on surface 12. Likewise, projectile 25A would score points in accordance with the rules of the game by having passed through aperture 13 into the interior of receptacle 11 as a result of an accurate toss by a player.

Figure 4:
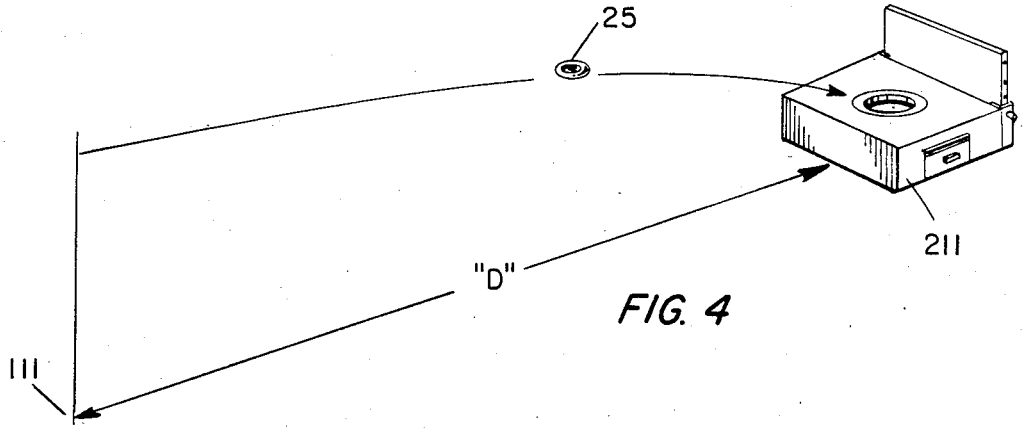
FIG. 4 is a schematic representation of the game apparatus in one actual setup possibility.

Referring now to FIG. 4, there is shown a typical setup of the game apparatus using two of the target devices. The target devices 111 and 211 can be spaced apart by any suitable distance D which will be a function of the playing area and the type of disk projectile 25 which is used.

In accordance with the proposed rules of the game and the utilization of this apparatus, a player will be allotted a specified number of projectiles 25. In typical fashion, each player receives a specified number, for example 4, of such projectiles. The players position themselves a prescribed distance from the target receptacle and take turns tossing the projectiles 25 at the respective targets 111 or 211. The players take turns and alternate in tossing the projectiles towards the target. It could be permissible for one player to attempt to knock the disk 25 of another player off of the surface in order to prevent a scoring effort. Conversely, a player can deliberately or inadvertently knock another player's projectile into the target area (or even through the aperture) and award a scoring effort to the other player. While it is not essential to the invention, it makes the game easier to play if the projectiles are fabricated of different colored material or have other suitable indicia thereon. While it is also considered that two players can participate, any number of players can be accommodated whereby team competitions or multiple competitions can be engaged in at any time.

The type of pattern 18 which is shown in the Figures can be in the nature of a typical target arrangement, i.e. comprised of a plurality of concentric circles with different scores being awarded for different circles depending upon closeness to the aperture 13. However, other patterns can be provided, for example, providing higher point scores for causing the projectile 25 to come to rest at a corner of the surface 12 rather than immediately adjacent to the aperture 13.

Also, it is contemplated that the receptacle 11 need not be completely rectilinear in configuration. In an alternative embodiment, the front end of the receptacle 11 may be arcuate in configuration, as suggested by dashed line 35. In all other respects, the receptacle 11 would remain three dimensional so as to receive the thrown or tossed projectile. With the arcuate configuration suggested by dashed line 35, the apparatus resembles a commode. Consequently, with this configuration and with the configuration normally suggested in FIG. 1, this game has been dubbed "Toilets". This nomenclature is not intended to be derogatory or offensive, but is directed to the general configuration of the apparatus.

In a preferred embodiment, the receptacle 11 is fabricated of wood or other similar material of sufficient strength and durability to function properly. However, other materials such as a durable plastic, heavy cardboard or the like can be utilized. The projectiles or disks are typically, fabricated of a rubber-like material, other materials may be used herein as well. The dimensions of the receptacle 11 are, in one embodiment, 18 inches wide by 14 inches long and 4 inches high. The backboard 15 can be adjustable from 0 to approximately 4 inches above the surface 12. With these dimensions, the aperture 13 is approximately 3.5 inches in diameter and the disks are 2.5 inches in diameter.

In another embodiment, in order to add another element of skill, the projectiles can have different colors or suitable indicia on the opposite surfaces. In this case, only projectiles landing with a particular color (or indicia) surface upwardly would constitute a scoring effort.

The number of points for each effort and the methods of scoring can be modified by the users. For example, in a preferred utilization, only one player can score points by tossing the projectile through the aperture or being closest thereto. In the event of ties for closeness, no points are awarded. (Conversely, each player could be awarded points.) In the case of two players successfully tossing a projectile through the aperture only the second player would score points and these would be double the usual point allotment for such a successful toss. Of course, other point scoring arrangements can be devised.

Thus, there is shown and described a unique game apparatus. Those skilled in the art may develop modifications to this game apparatus. However, any such modifications which fall within the purview of this description are intended to be included therein as well. This description is intended to be illustrative of the invention only and is not intended to be limitative. Rather, the scope of the invention is limited only by the claims appended hereto.

I claim:

1. A game apparatus comprising, a hollow receptacle including at least an upper surface, an aperture through said upper surface, said aperture including a beveled edge at said upper surface, a bankboard at one end of said receptacle and extending above said upper surface, and a least one object which can be tossed at said receptacle with the intention of passing said object through said aperture directly or after a carom off of said bankboard.

2. The apparatus recited in claim 1 wherein, said bankboard is vertically adjustable relative to and independently of said receptacle.

3. The apparatus recited in claim 2 including, at least one positioning apertures in the edges of said bankboard, and at least one positioning peg which can be selectively positioned in said positioning aperture in said bankboard in order to control the position of said bankboard relative to said receptacle.

4. The apparatus recited in claim 1 wherein, said receptacle is rectilinear in configuration.

5. The apparatus recited in claim 1 wherein, said receptacle is substantially cubical in configuration.

6. The apparatus recited in claim 1 wherein, said object is substantially rigid.

7. The apparatus recited in claim 1, including, door means in a side of said receptacle wherein access to the interior thereof is permitted.

8. The apparatus recited in claim 1 wherein, said receptacle has an arcuate configuration at the end thereof which is opposite said one end.

9. The apparatus recited in claim 1 wherein, said object is substantially disc shaped.

10. The apparatus recited in claim 1 wherein, said object includes different indicia on the opposed surfaces thereof.

11. The apparatus recited in claim 1 including, target patterns disposed in said upper surface.

12. The apparatus recited in claim 11 wherein, said target pattern on said on said upper surface comprises concentric rings disposed around said aperture

13. The apparatus recited in claim 1 wherein, said bankboard has the same width as said one end of said receptacle.

14. The apparatus recited in claim 1 including, support means affixed to the rear of said receptacle and adapted to receive and support said bankboard.

15. The apparatus recited in claim 14 wherein, said support apparatus includes grooves in which said bankboard is adjustably mounted.

* * * * *